US009257804B1

(12) United States Patent
Beck et al.

(10) Patent No.: US 9,257,804 B1
(45) Date of Patent: Feb. 9, 2016

(54) PITCH AGNOSTIC BUS-BAR WITH PITCH AGNOSTIC BLIND MATE CONNECTOR

(71) Applicant: Google Inc., Mountain View, CA (US)

(72) Inventors: Jonathan David Beck, Mountain View, CA (US); Jeffrey Scott Spaulding, Sunnyvale, CA (US); Debosmita Das, Sunnyvale, CA (US); Richard Lidio Blanco, Santa Clara, CA (US); Mark Ramon Imbertson, Pleasanton, CA (US)

(73) Assignee: Google Inc., Mountain View, CA (US)

( * ) Notice: Subject to any disclaimer, the term of this patent is extended or adjusted under 35 U.S.C. 154(b) by 42 days.

(21) Appl. No.: 14/065,899

(22) Filed: Oct. 29, 2013

(51) Int. Cl.
*H01R 25/14* (2006.01)

(52) U.S. Cl.
CPC ..... *H01R 25/142* (2013.01)

(58) Field of Classification Search
USPC ..... 439/116, 120–122, 517, 843, 845
See application file for complete search history.

(56) References Cited

U.S. PATENT DOCUMENTS

| | | | | | |
|---|---|---|---|---|---|
| 3,521,332 | A * | 7/1970 | Kramer | 403/188 |
| 4,013,329 | A * | 3/1977 | Hugin | 439/33 |
| 4,553,799 | A * | 11/1985 | Deters | 439/507 |
| 4,775,338 | A * | 10/1988 | Norden | 439/831 |
| 5,160,285 | A * | 11/1992 | Murray | 439/801 |
| 5,421,751 | A * | 6/1995 | Bennett et al. | 439/843 |
| 5,431,576 | A * | 7/1995 | Matthews | 439/247 |
| 5,980,311 | A * | 11/1999 | Campbell et al. | 439/517 |
| 6,089,929 | A * | 7/2000 | Sloey | 439/845 |
| 6,402,525 | B2 * | 6/2002 | Gugliotti et al. | 439/65 |
| 6,561,844 | B1 * | 5/2003 | Johnson | 439/507 |
| 6,773,314 | B2 * | 8/2004 | Mills et al. | 439/850 |
| 7,011,548 | B2 * | 3/2006 | Bogiel et al. | 439/630 |
| 7,014,516 | B2 * | 3/2006 | Yang | 439/845 |
| 7,062,886 | B2 * | 6/2006 | Auriemma | 52/506.07 |
| 7,581,972 | B2 * | 9/2009 | Daamen | 439/249 |
| 7,766,706 | B2 * | 8/2010 | Kawamura et al. | 439/839 |
| D632,260 | S * | 2/2011 | Smith | D13/154 |
| 7,997,910 | B2 * | 8/2011 | Myers et al. | 439/121 |
| 8,182,299 | B2 * | 5/2012 | Schrader | 439/857 |
| 8,388,389 | B2 * | 3/2013 | Costello et al. | 439/839 |

(Continued)

OTHER PUBLICATIONS

"Crown Clip Junior Direct Power Connection for Bus Bars." Tyco Electronics, Ltd. Catalog 1654261-8, Issued Sep. 2008. [Retrieved Nov. 8, 2013]. Retrieved from the Internet: <www.te.com/catalog/Presentations/CrownClipJrPresentation.pdf>, 8 pages.

(Continued)

*Primary Examiner* — Alexander Gilman
(74) *Attorney, Agent, or Firm* — Lerner, David, Littenberg, Krumholz & Mentlik, LLP

(57) ABSTRACT

The present disclosure provides various bus bar connectors configured to draw power from a bus bar at non-discrete locations. In one aspect, a bus bar connector may include a connector housing having a slot. The slot may be configured to allow the connector housing to grip a bus bar at different locations. First and second electrical contacts may be disposed on opposite sides of the slot. The bus bar connector includes mounting members for securing the connector housing against an enclosure for the bus bar and a spring clip that can be to attach to upper and lower outer surfaces of the connector housing to provide an amount of contact force onto the outer surface of the connector housing. The amount of contact force enables the first and second electrical contacts to securely grip the bus bar.

20 Claims, 8 Drawing Sheets

(56) References Cited

U.S. PATENT DOCUMENTS

| | | | | |
|---|---|---|---|---|
| 8,881,481 | B2 * | 11/2014 | Myers et al. | 52/506.08 |
| 2007/0057130 | A1 * | 3/2007 | Nikayin et al. | 248/216.1 |
| 2010/0050561 | A1 * | 3/2010 | Jafari | 52/712 |

OTHER PUBLICATIONS

"Power Connectors & Interconnection Systems." Tyco Electronics, Ltd. Catalog 1773096, Revised Feb. 2010. [Retrieved Nov. 8, 2013]. Retrieved from the Internet: <http://www.te.com/commerce/DocumentDelivery/DDEController?Action=srchrtrv&DocNm=1773096_FULL_POWER_CATALOG&DocType=CS&DocLang=EN>, 11 pages.

"Quick Reference Guide Bus Bar Connectivity." Tyco Electronics Corporation, a TE Connectivity Ltd. company. © 2013. [Retrieved Nov. 8, 2013]. Retrieved from the Internet: <www.te.com/products/busbar>, 6 pages.

* cited by examiner

100A

PITCH AGNOSTIC BUS-BAR WITH PITCH AGNOSTIC BLIND MATE CONNECTOR

BACKGROUND

In electrical power distribution, bus bars are strips of material (e.g., copper) used to conduct electricity within an apparatus, such as a distribution board, switchboard, and substation. These bus bars are designed to distribute electricity to separate components connected to the apparatus. Typically, the apparatus may be pre-configured at certain locations to facilitate connections between the bus bar and the separate components. However, some components of different shapes and sizes are unable or rather difficult to connect to a bus bar at these pre-configured locations.

BRIEF SUMMARY

Aspects of the disclosure may be advantageous for providing various bus bar connectors configured to draw power from a bus bar at non-discrete locations. One aspect of the present technology provides a bus bar connector. The bus bar connector includes a connector housing having a slot. The slot can be configured to allow the connector housing to grip a bus bar at different locations. First and second electrical contacts are disposed on opposite sides of the slot. The bus bar connector includes mounting members for securing the connector housing against an enclosure for the bus bar. The bus bar connector also includes a spring clip configured to attach to upper and lower outer surfaces of the connector housing to provide an amount of contact force onto the outer surface of the connector housing. The amount of contact force may enable the first and second electrical contacts to securely grip the bus bar.

In one example, the mounting members may include rear contacts attached to the connector housing. The rear contacts may be adapted to accept mounting lugs for securing the housing to the enclosure.

In one example, the first and second electrical contacts include contact fingers. The contact fingers are configured on a surface of each electrical contact facing the bus bar to increase gripping power of the connector housing onto the bus bar.

In one example, the first and second electrical contacts include a ring terminal configured on a tab portion of each contact. The ring terminal may be configured to receive an electrical component.

In one example, the first and second electrical contacts include a terminal positioned on a tab portion of each contact, the terminal being configured to receive a wiring component to attach one or more wires to the first and second electrical contacts.

Another aspect of the present technology provides a system. The system includes a bus bar for supplying current from a power supply to a device and a bus bar connector. The bus bar connector includes a housing having a slot. The slot can be configured to allow the housing to grip the bus bar at different locations. First and second electrical contacts disposed on opposite sides of the slot. In this regard, the bus bar can be configured between the first and second electrical contacts. The bus bar connector includes mounting members for securing the connector housing against an enclosure for the bus bar. The bus bar connector also includes a spring clip configured to attach to upper and lower outer surfaces of the connector housing to provide an amount of contact force onto the outer surface of the connector housing. The amount of contact force may enable the first and second electrical contacts to securely grip the bus bar.

DETAILED DESCRIPTION

Aspects, features and advantages of the disclosure will be appreciated when considered with reference to the following description of embodiments and accompanying figures. The same reference numbers in different drawings may identify the same or similar elements. Furthermore, the following description is not limiting; the scope of the present technology is defined by the appended claims and equivalents. While certain processes in accordance with example embodiments are shown in the figures as occurring in a linear fashion, this is not a requirement unless expressly stated herein. Different processes may be performed in a different order or concurrently. Steps may also be added or omitted unless otherwise stated.

The subject matter of the present disclosure generally relates to creating a flexible bus bar connector that can draw power from a bus bar at non-discrete locations. This can allow electronic components and other types of payloads connected to an apparatus, such as a distribution board, to have the flexibility to vary in widths and sizes by being able to freely attach to the bus bar along any position.

Figure 1:
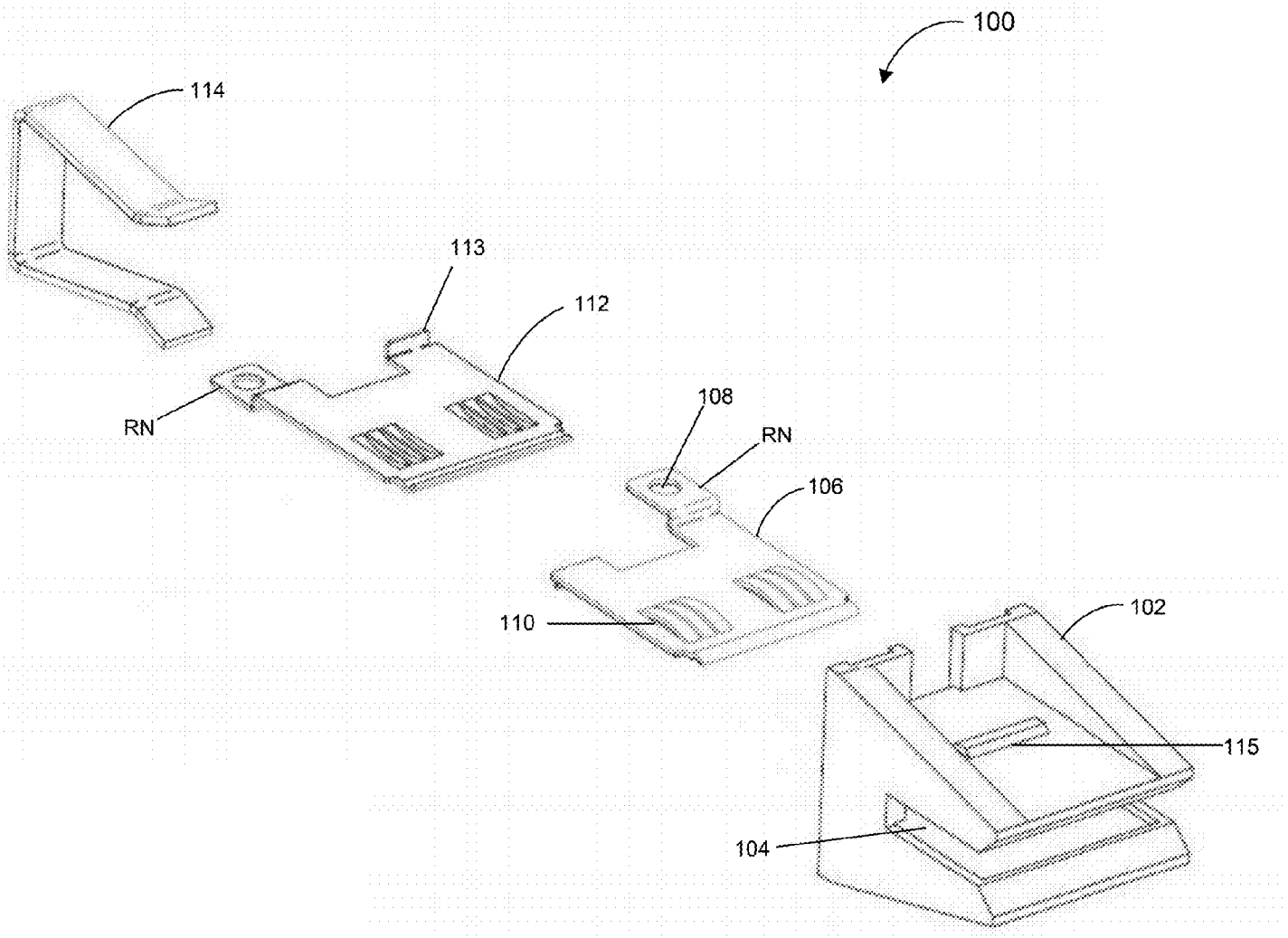
FIG. 1 is an exploded perspective view of an example of a bus bar connector in accordance with one aspect.

FIG. 1 is an exploded perspective view of an example of a bus bar connector 100. In this example, the bus bar connector 100 includes a housing 102 for accommodating various parts of the bus bar connector 100. The housing 102 can be a type of synthetic or non-synthetic polymer (e.g., a glass-filled nylon or plastic) that provides stability and a degree of flexibility when force is applied. According to aspects, the housing 102 may be configured to receive a bus bar, such as a laminated bus bar comprised of two strips of an electrically conductive material (e.g., copper) with an insulator between them where power can be carried on one of the strips and a return path (e.g., ground) on the other. The bus bar can provide an electrical power source to a plurality of electrical components attached to the bus bar connector 100.

In order to receive a bus bar, the bus bar connector 100 may include a slot 104. As shown in FIG. 1, the bus bar housing 102 includes a slot 104 that extends along a longitudinal axis of the housing 102. When the housing is matted with a bus bar, the slot 104 may be parallel to a longitudinal axis of the bus bar (not shown). In some aspects, the slot 104 may be adapted to allow the bus bar to pass through the housing 102. For example, upon receiving a bus bar at slot 104, the housing 104 can be moved along the bus bar by passing the bus bar through the slot 104 along the longitudinal axis of the housing 102.

The bus bar connector 100 may be configured to make electrical contact with the bus bar. For example, as shown in FIG. 1, the bus bar connector 100 also includes a first electrical contact plate 106 capable of conducting electricity. The first electrical contact plate 106 includes a ring terminal 108 configured on a rear tab portion RN of the plate 106. This terminal 108 can be adapted to receive a type of ring fastener (not shown) that holds an electrical component, such as a printed circuit board (PCB), server, computing device or other types of devices requiring an electrical current, onto the plate 106. From the ring terminal 108, power can be feed, for example, to a connected electrical component that returns through the bus bar connector 100.

In order to make electrical contact with the bus bar, the bus bar connector 100 also includes a second electrical contact plate 112 similar to the first electrical contact plate 106. For example, the second electrical contact plate 112 also includes a ring terminal configured on a rear tab portion RN of the plate 112. The second electrical contact plate 112 differs in that it is oriented opposite to corresponding portions of the first electrical contact plate 106.

In some aspects, the electrical contact plates can be adapted to receive a wiring component (such as O-ring wire connector that includes electrical insulation surrounding one or more wires or other types of wire connectors), which may be capable of accepting one or more wires. In this way, the bus bar connector 100 can be configured from being a board-mounted connector, such as a connector for matting a PCB onto a bus bar, to a cable-mounted connector. For example, a terminal (not shown) can be configured on the rear tab RN portion of the first and second electrical contact plates 106 and 112. In this example, the terminal may receive a wiring component that can attach one or more wires to each plate.

According to aspects, each electrical contact plate can also include contact fingers or ridges. As shown in the example of FIG. 1, the first electrical contact plate 106 includes a number of contact fingers 110 arranged on a surface of the plate 106 which may be facing the bus bar. An advantage of the contact fingers 108 is that they can increase gripping strength of the contact plate when held against the bus bar. This process of engaging contact plates for gripping a bus bar is further described below.

To facilitate matting of the bus bar connector 100 with a bus bar, the electrical contact plates of the connector may be inserted into the slot 104 and configured opposite to each other. For example, the first electrical contact plate 106 may be inserted into slot 104 below the second electrical contact plate 112. In some aspects, the first and second electrical contact plates 106 and 112 may include a stopper device to ensure the contact plates as inserted correctly. In this regard, the stopper device can include a stopper 113 that may indicate when a particular contact plate has been fully inserted into the housing 102. For example, upon insertion of the electrical contact plates 106 and 112 into housing 102, the stopper device may engage a part of the housing 102 indicating that the contact plates are fully inserted. Having the contact plates fully inserted into the housing 102 can ensure a maximum level of electrical contact with the bus bar when the bus bar connector 100 is matted with the bus bar.

The first and second electrical contact plates 106 and 112 can be held against or otherwise grip opposite sides of a bus bar passing between the plates through slot 104. For example, a means of applying an amount of contact force to the housing 102 can be employed to bring the two respective contact plates into electrical contact with the bus bar, thereby making a full electrical circuit between the bus bar and an electrical component attached to the bus bar connector 100.

For applying a desired amount of clamping force (e.g., approximate 25 lbs) to the housing 102 for gripping a bus bar, the bus bar connector 100 may also include a spring clip 114. For example, the housing 102 can be configured to allow insertion and removal of the spring clip 114. In some aspects, the spring clip 114 may be received at respective connector groves positioned on the housing 102. As shown in FIG. 1, for example, the housing 102 may include a grove 115 for receiving the spring clip 114 configured on an upper and lower outer surface of the housing 102.

The spring clip 114 may be a material such as a lightweight metal or another type of resilient material that can be repetitively flexed and returns to an original position after manipulation. In addition to proving an amount of clamping force, an advantage of the spring clip is that it can be used to prevent creeping (e.g., a tendency of a solid material to move slowly or deform over time) of the housing 102 on the bus bar.

Figure 1A:
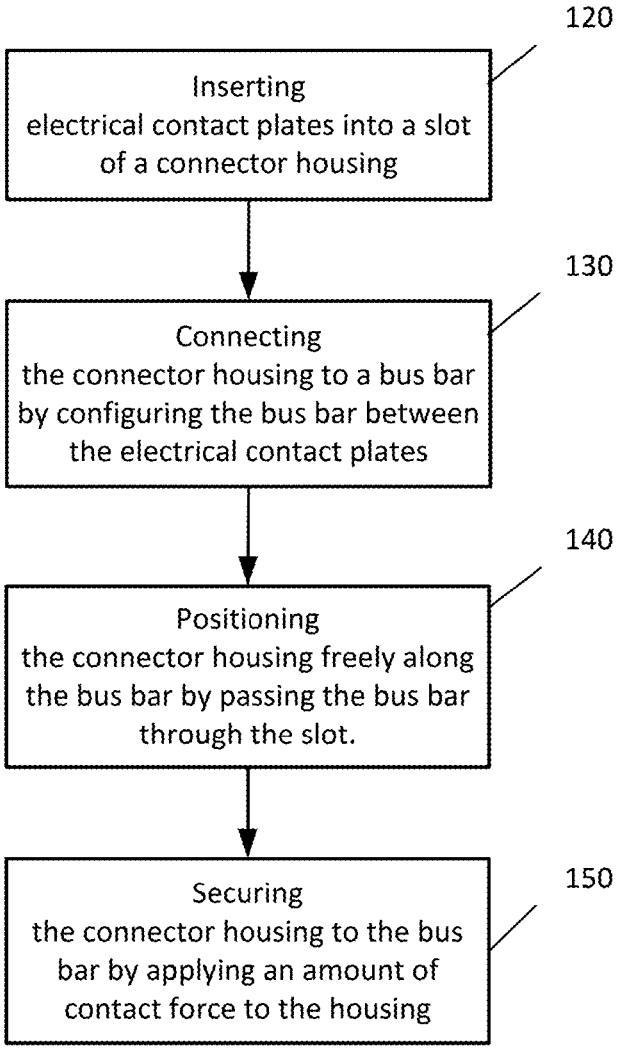
FIG. 1A is an example of a flow diagram in accordance with one aspect.

FIG. 1A is an example of a flow diagram 100A for example, of how the bus bar connector 100 of FIG. 1 may be assembled.

At block 120, electrical contact plates are fully inserted into a slot in a connector housing. For example, the first and second electrical contact plates 106 and 112 are inserted into slot 104 of the housing 102, whereby the contact plates are positioned on opposite sides of the slot 104.

At block 130 the connector housing may be connected to a bus bar by configuring the bus bar between the electrical contact plates. For example, the bus bar connector 102 may be matted with a bus bar by fitting the bus bar into the housing 102 through slot 104 so that the housing 102 holds the bus bar between the first and second electrical contact plates 106 and 112.

At block 140, the connector housing may be freely positioned along the bus bar by passing the bus bar through the slot. For example, the housing 102 holding the bus bar may be freely positioned along a longitudinal axis of the bus bar by passing the bus bar through the slot 104.

At block 150, the connector housing may be secured to the bus bar by applying an amount of contact force (e.g., lbs) to the housing. During assembly of the bus bar connector 100, an amount of clamping force may be applied to the housing 102 using, for example, spring clip 114, such the housing 104 is secured to the bus bar.

Figure 2B:
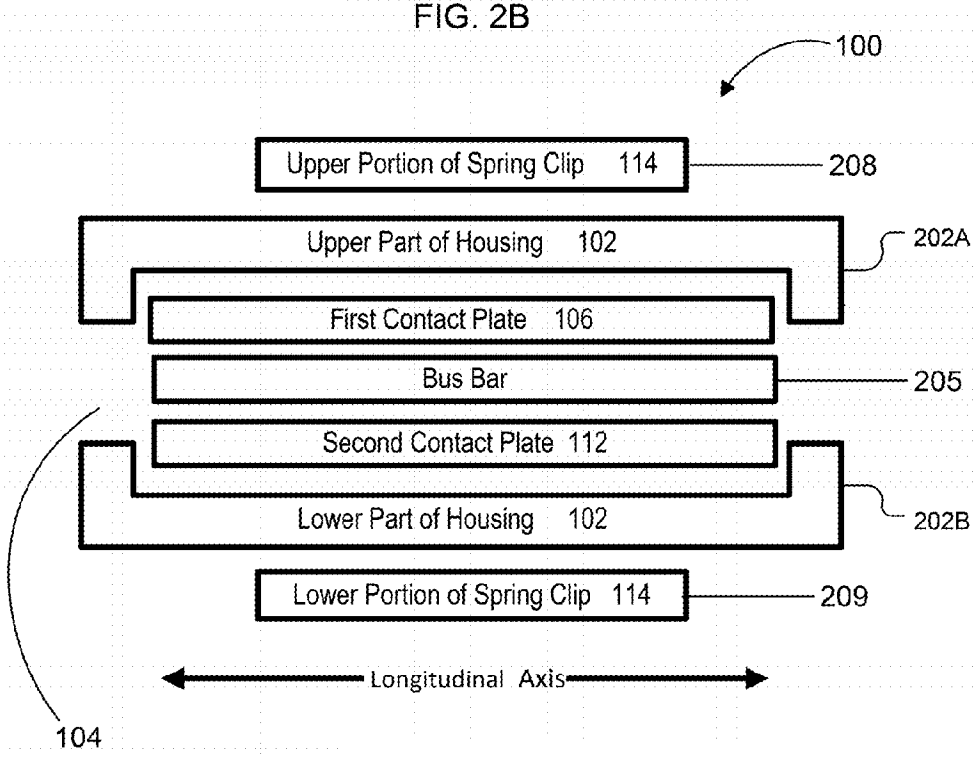
FIG. 2B is a cross sectional diagram of an assembled bus bar connector in accordance with one aspect.
Figure 2A:
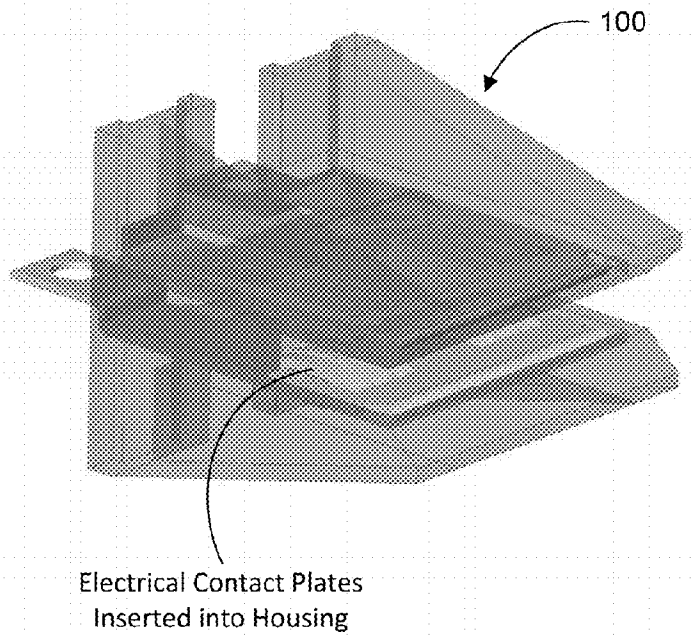
FIG. 2A is an example of an assembled bus bar connector in accordance with one aspect of the disclosure.

FIGS. 2A-2B are examples of assembled bus bar connectors, for example, FIG. 2A is an assembled bus bar connector 100 and FIG. 2B is a cross-sectional diagram of an assembled bus bar connector 100. Although in these examples a particular contact plate is illustrated as being placed on top of the other, the contact plates may be configured in various orientations, for example, by rotating a longitudinal axis of the housing 102. In this way, the contact plates may be configured vertically or horizontally with respect to an orientation of a longitudinal axis of a bus bar passing through the housing 102 between the plates.

As shown in FIG. 2B, bus bar 205 may be disposed between the first contact plate 106 and the second contact plate 112 inside of a slot 104 of the housing 102. As discussed above, an amount of contact force can be applied to the housing 102 in order for the assembled bus bar connector 100 to grip the bus bar 205. For example, spring clip 114 may have an upper and lower portion 208 and 209 configured so that the upper portion 208 rests on an upper part of the housing 202A while the lower portion 208 rests on lower part of the housing 202B, opposite of 202B. In some aspects, the spring clip 114 can adjust from a first position (e.g., an original position) to a second position (e.g., the upper and lower portions 208 and 209 bending outwards in opposite directions) which allows the clip 114 to be placed over the housing 102. As the spring clip 114 reforms back to the first position, force is applied to respective parts of the housings 102 thereby holding the first and second contact plates 106 and 112 against the bus bar 205.

Figure 3:
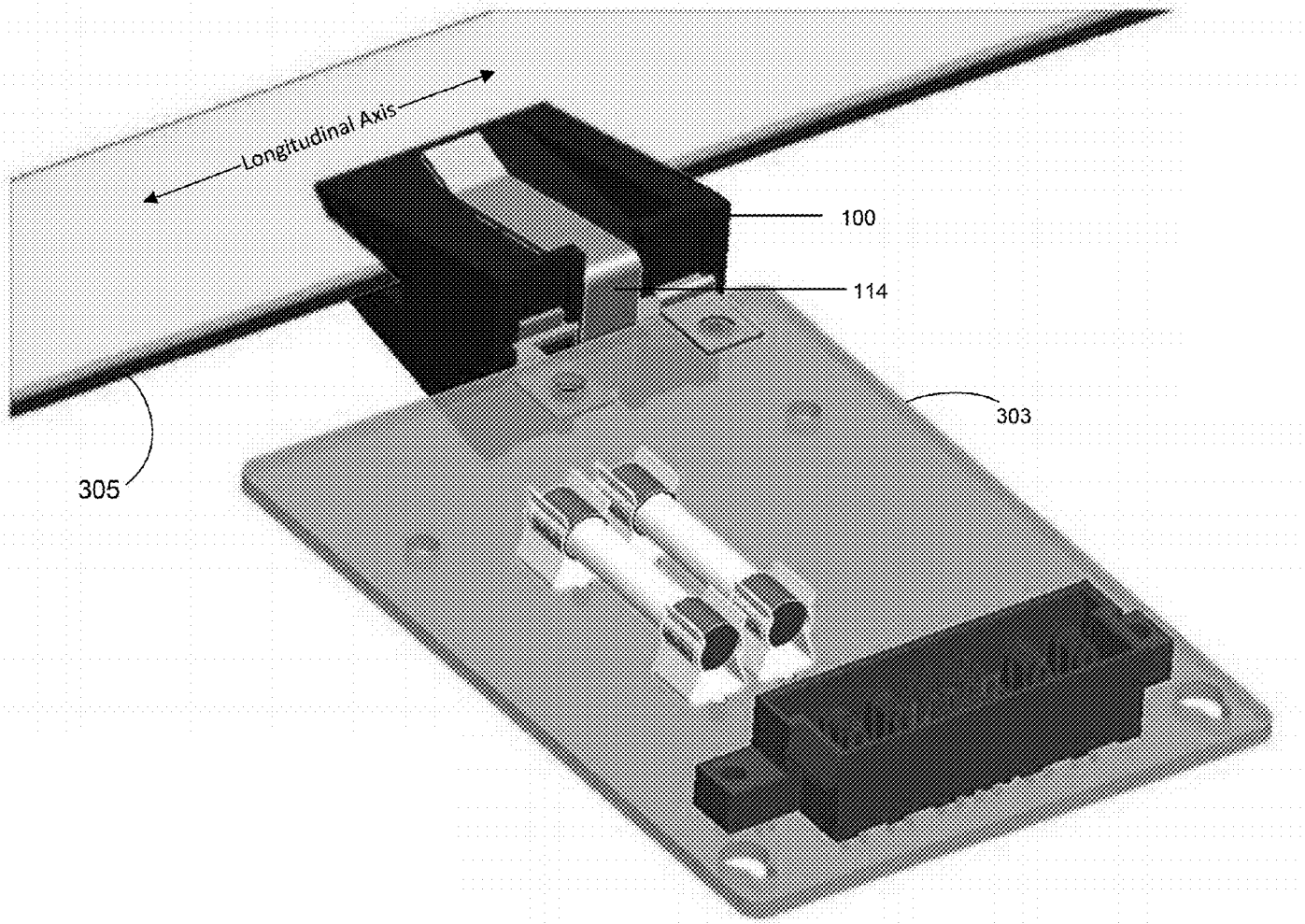
FIG. 3 is an example of an assembled bus bar connector connected to a bus bar in accordance with aspects of the disclosure.

In FIG. 3, an example of an assembled bus bar connector 100 connected to a bus bar 305 is shown. According to aspects, the assembled bus bar connector 100 may be connected to the bus bar 305 at various locations along the bus bar 305. For example, the connector can be laterally arranged freely along a longitudinal axis of the bus bar 305 by passing the bus bar though a slot in the connector 100. Once positioned, the bus bar connector 100 may be held against the bus bar 305, for example, by using spring clip 114. In this example, upon connecting the assembled bus bar connector 100 to bus bar 305, a power current may begin flowing from the bus bar 305 through the connector 310 to an attached electrical component 303.

Figure 4:
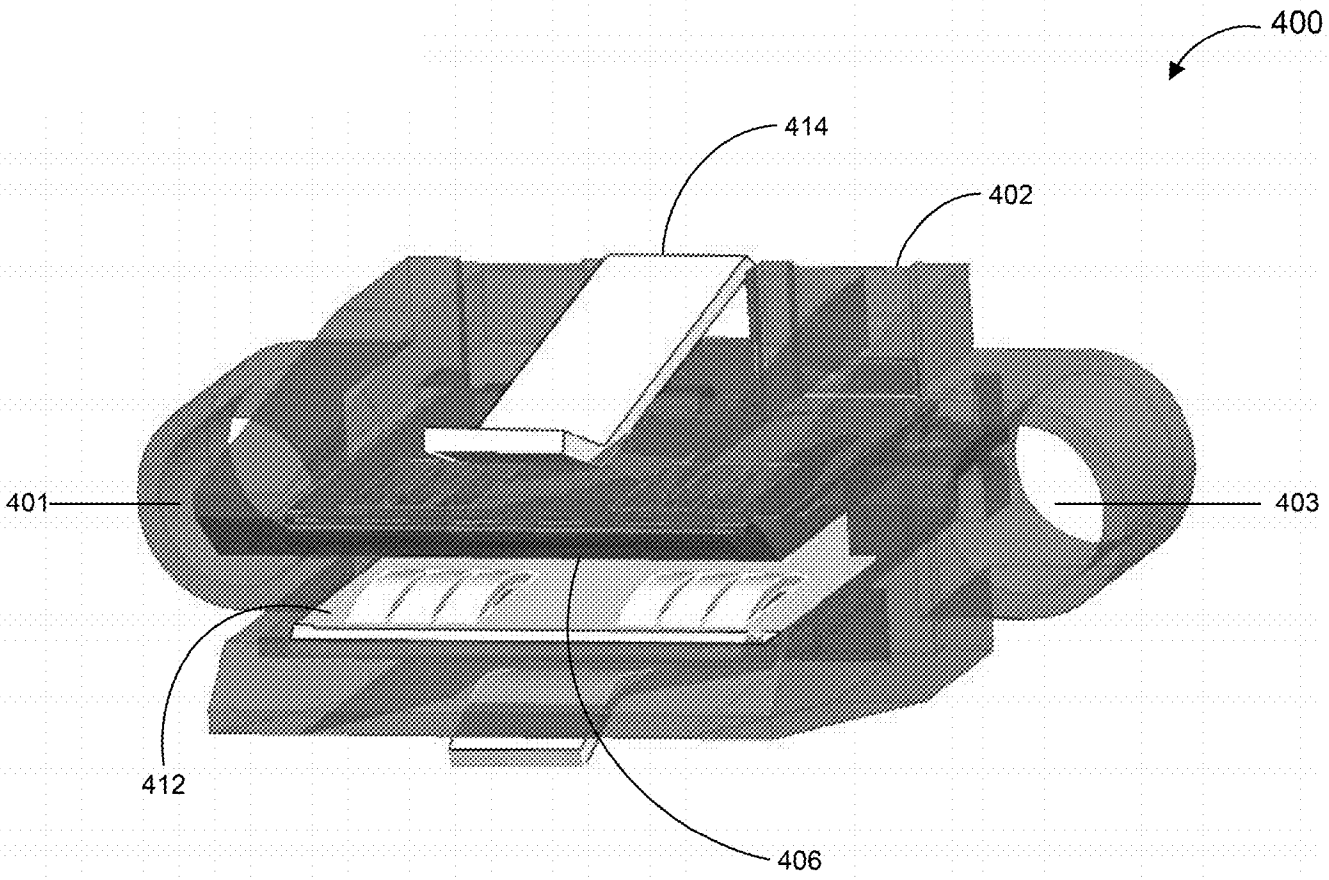
FIG. 4 is an example of a bus bar connector including panel-mounting features in accordance with one aspect of the disclosure.

FIG. 4 is an illustration of a bus bar connector 400 including panel-mounting features. In this example, the bus bar connector 400 is configured similar to connector 100 from FIG. 1. For example, connector 400 includes a housing 402, electrical contact plates 406 and 412 disposed within a slot 404 of the housing 402, and a spring clip 414 similar to the housing 102, electrical contact plates 106 and 112, slot 114 and spring clip 114. As with spring clip 114, spring clip 414 can be configured to apply force on the housing 412 to hold the connector 400 to a bus bar. In one aspect, the panel-mounting features may comprise mounting brackets 401 and 403, which can be configured at each side of the housing 402. The panel mounting features may allow the housing 402 to be attached, for example, to a sheet metal chassis or other material used as a housing for a bus bar. Each mounting bracket can be adapted to receive a threaded or non-threaded mounting lug (not shown), which can be screwed or otherwise inserted into that mounting bracket for securing the housing 402 to the chassis. Although the panel-mounting features (e.g., mounting brackets 401 and 403) are illustrated in FIG. 4 at opposite sides of the housing 402, these features may be configured at different positions on the housing 402 as necessary for securing the housing 402 in place.

Figure 5:
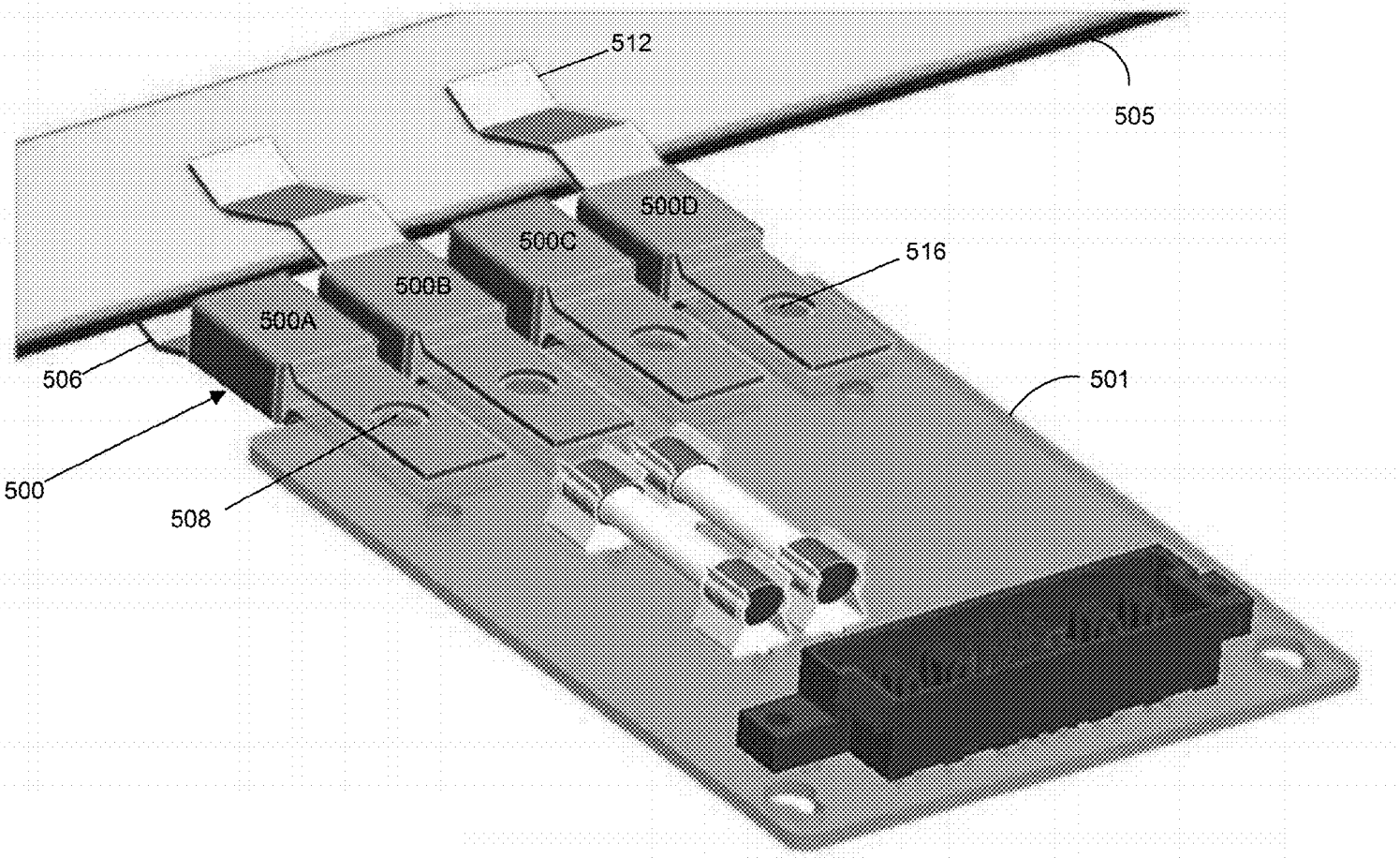
FIG. 5 is an example of a bus bar connector connecting an electrical component to a bus bar in accordance with one aspect of the disclosure.

FIG. 5 is an example of a bus bar connector 500 connecting an electrical component 501 to a bus bar 505. In this example, the connector 500 includes a plurality, here four, of individual sub-connectors 500A-D, where sub-connector 500A is equivalent to sub-connector 500C and sub-connector 500D is equivalent to sub-connector 500B. As shown in FIG. 5, bus bar sub-connector 500A includes an electrical contact portion 506 capable of conducting electricity and a ring terminal 508 configured on a rear tab portion of the sub-connector 500A. In some aspects, the ring terminal 508 can be in communication with the electrical component 501.

Bus bar connector 500 also includes bus bar sub-connector 500D having an electrical contact portion 512 and a ring terminal 516 configured on a rear tab portion. The bus bar sub-connector 500D differs from sub-connector 500A in that the electrical contact portion 512 is oriented opposite to corresponding portions of the electrical contact portion 506 of the bus bar sub-connector 500A.

According to aspects, the electrical contact portions 504 and 510 (and those of sub-connectors 500B and 500C) may be adapted to receive the bus bar 505. For example, contact portions of the bus bar sub-connectors can flex so that bus bar 505 can freely pass between them. In this regard, each contact portion may be a type of resilient material that can be repetitively flexed and returns to an original position after manipulation.

The contact portions can flex from a first position (e.g., an original position) to a second position (e.g., bending backwards) thereby allowing the bus bar to be positioned in between the contact portions. As the contact portions return back to the first position, they may hold or otherwise grip the bus bar 505 at a location. Thereupon, current may begin flowing from the bus bar 505 to the connected electrical component 501. For example, a power current may flow through the bus bar sub-connector 500D to the connected electrical component 501 and return through the bus bar sub-connector 500A.

Figure 6:
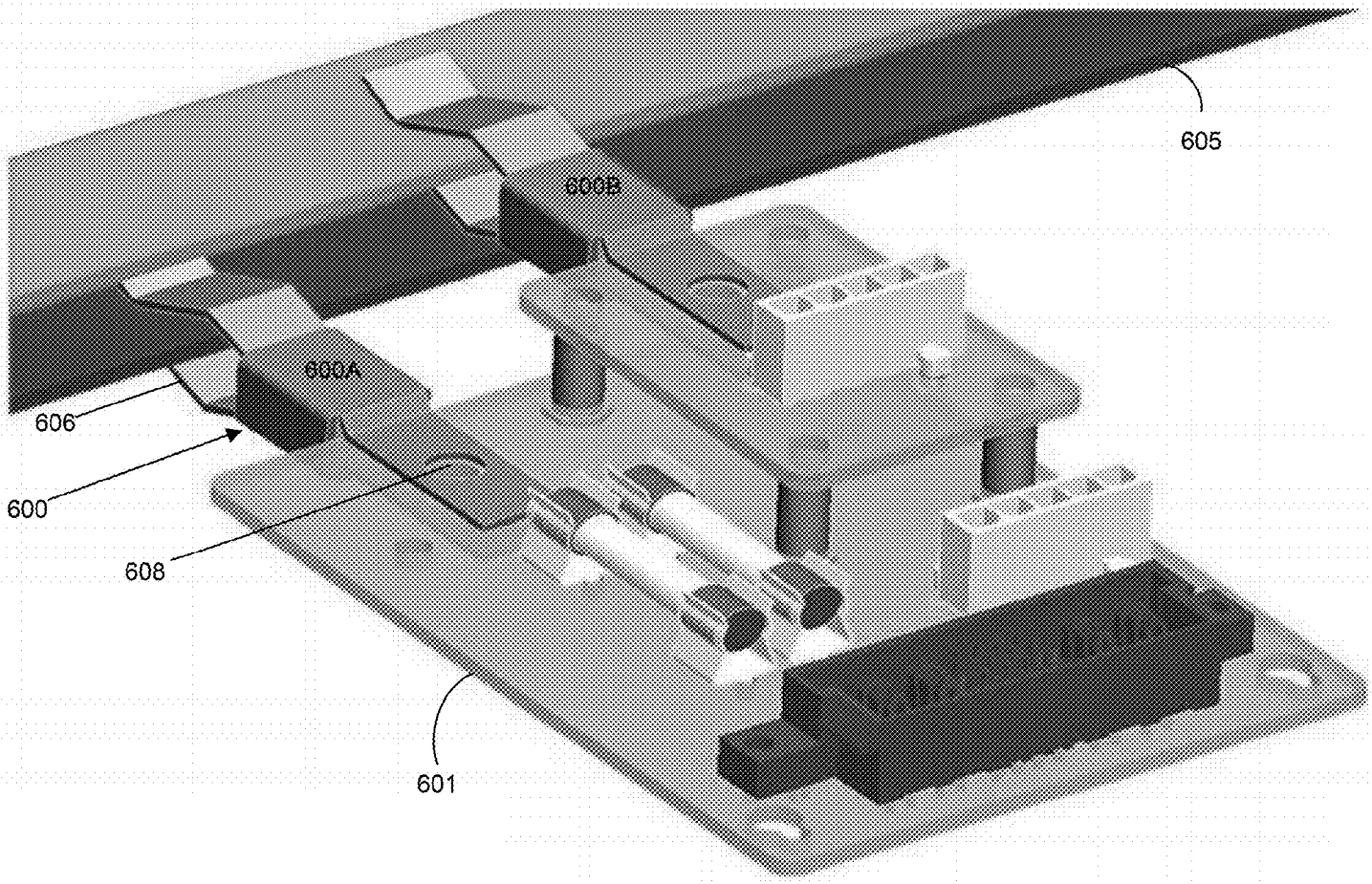
FIG. 6 is another example of a bus bar connector connecting an electrical component to a bus bar in accordance with one aspect of the disclosure.

In FIG. 6, another example of a bus bar connector 600 connecting an electrical component 601 to a bus bar 605 is shown. As with FIG. 5 above, connector 600 includes a plurality, here two, of individual sub-connectors 600A-B, where sub-connector 600A is equivalent to sub-connector 600B. Each bus bar connector includes an electrical contact portion 606 comprising first and second electrical contact plates (which can be compared to the first and second electrical contact plates 106 and 112 of FIG. 1) that are capable of conducting electricity, and a ring terminal 608 (which can be compared to the ring terminal 108 of FIG. 1) configured on a rear tab portion of the connector. In some aspects, the ring terminal 608 can be in communication with the electrical component 601.

According to aspects, the bus bar connector 602 can be configured to receive the bus bar 605. For example, the first and second electrical contact plates can be configured to create a slot where a portion of bus bar 605 can freely pass through. To position a portion of the bus bar 605 within the slot, the contact plates can flex from a first position (e.g., an original position) to a second position (e.g., outwardly in opposite directions) thereby allowing the slot to be able to receive the bus bar 605. In this regard, the electrical contact plates are a type of resilient material that can be repetitively flexed and returns to an original position after manipulation. As the contact plates return back to the first position, they can grip the bus bar 605 at different locations. In some aspects, current may begin flowing from the bus bar 605 to the connected electrical component 601. For example, a power current may flow through bus bar connector 608 to the connected electrical component 601 and return through the bus bar connector 602.

Figure 7:
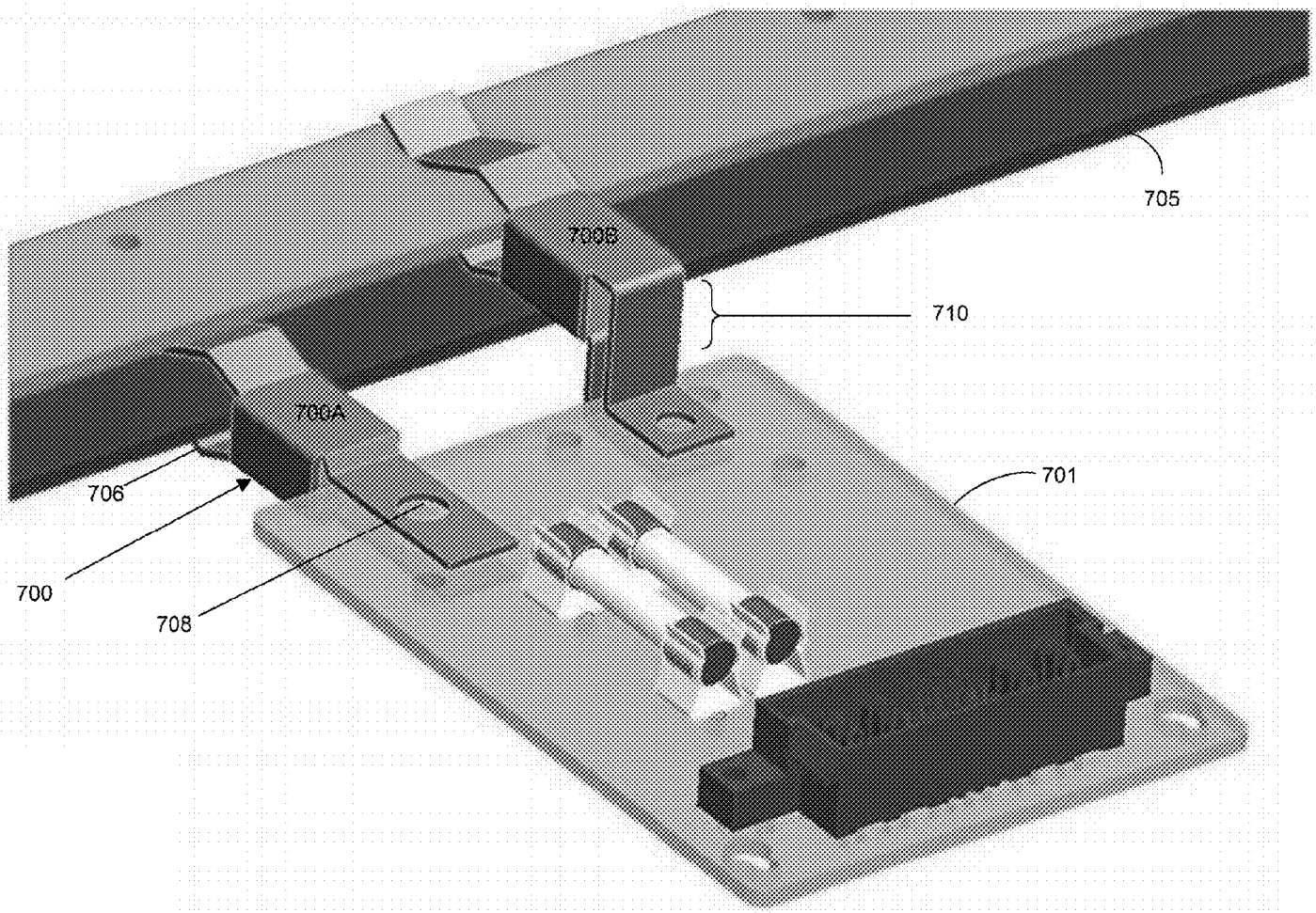
FIG. 7 is yet another example of a bus bar connector connecting an electrical component to a bus bar in accordance with one aspect of the disclosure.

In FIG. 7, yet another example of a bus bar connector 700 connecting an electrical component 701 to a bus bar 705 is shown. As with FIGS. 5 and 6 above, connector 700 includes a plurality, here two, of individual sub-connectors 700A-B. Each bus bar connector includes an electrical contact portion 706 comprising first and second electrical contact plates (which can be compared to the first and second electrical contact plates 106 and 112 of FIG. 1) capable of conducting electricity, and a ring terminal 708 (which can be compared to the ring terminal 108 of FIG. 1) configured on a rear tab portion of the connector. The ring terminal 708 can be in communication with the electrical component 701.

In some aspects, the bus bar sub-connectors can include an extension portion 710 configured between the electrical contact and rear tab portion of the sub-connectors.

According to aspects, the bus bar sub-connectors 700A-B may be configured to receive bus bar 705. For example, the first and second electrical contact plates can be configured to create a slot where a portion of the bus bar 705 can freely pass through. To position a portion of the bus bar 705 within the slot, the contact plates can flex from a first position (e.g., an original position) to a second position (e.g., outwardly in opposite directions) thereby allowing the slot to be able to receive the bus bar 705. As the contact plates return back to the first position, they may hold or otherwise grip the bus bar 705. In some aspects, current may begin flowing from the bus bar 705 to the connected electrical component 701. For example, a power current may flow through bus bar sub-connector 700B to the connected electrical component 701 and return through the bus bar sub-connector 700A.

As these and other variations and combinations of the features discussed above can be utilized without departing from the disclosure as defined by the claims, the foregoing description of the embodiments should be taken by way of illustration rather than by way of limitation of the disclosure as defined by the claims. It will also be understood that the provision of examples of the disclosure (as well as clauses phrased as "such as," "e.g.", "including" and the like) should not be interpreted as limiting the disclosure to the specific examples; rather, the examples are intended to illustrate only some of many possible embodiments.

The invention claimed is:

1. A bus bar connector, comprising:

a connector housing having a slot, the slot being configured to allow the connector housing to grip a bus bar at different locations;

first and second electrical contact plates disposed on opposite sides of the slot, the first and second electrical contact plates each including a plurality of contact fingers, the contact fingers being arranged on opposing surfaces of the first and second electrical contact plates facing the bus bar;

mounting members for securing the connector housing against an enclosure for the bus bar; and a spring clip configured to attach to upper and lower outer surfaces of the connector housing, the spring clip being adjustable between at least a first original position and a second position in which upper and lower portions of the spring clip bend outwards in opposite directions, the spring clip configured to provide an amount of contact force onto the outer surface of the connector housing, the amount of contact force causing the contact fingers on the first and second electrical contact plates to securely grip the bus bar.

2. The bus bar connector of claim 1, wherein the mounting members include rear contacts attached to the connector housing.

3. The bus bar connector of claim 2, wherein the rear contacts are configured to accept mounting lugs for securing the housing to the enclosure.

4. The bus bar connector of claim 1, wherein the first and second electrical contact plates include a ring terminal configured on a tab portion of each contact, the ring terminal being configured to receive an electrical component.

5. The bus bar connector of claim 1, wherein the first and second electrical contact plates include a terminal positioned on a tab portion of each contact, the terminal being configured to receive a wiring component to attach one or more wires to the first and second electrical contacts.

6. The bus bar connector of claim 1, wherein the housing is configured to allow insertion and removal of the spring clip.

7. The bus bar connector of claim 1, wherein the upper and lower outer surfaces of the connector housing include grooves for receiving the spring clip.

8. The bus bar connector of claim 7, wherein the grooves comprise a raised portion of the housing, the grooves extending along the upper and lower outer surfaces of the housing perpendicular to a longitudinal axis of the spring clip.

9. The bus bar connector of claim 1, wherein the amount of contact force provided by the spring clip onto the outer surface of the housing is approximately 25 lbs.

10. The bus bar connector of claim 1, wherein the housing further comprises first and second raised portions at respective back ends of the upper and lower outer surfaces of the housing, the raised portion extending perpendicularly with respect to the respective upper and lower outer surfaces, and each of the first and second raised portions including a recess corresponding in size and shape to the spring clip.

11. The bus bar connector of claim 1, wherein the spring clip includes a back edge connecting the upper and lower portions such that the upper and lower portions are angled towards each other from the back edge to a front section in the first original position.

12. The bus bar connector of claim 11, wherein only the front section of the spring clip maintains contact with the upper and lower outer surfaces of the housing.

13. A system, comprising:

a bus bar for supplying current from a power supply to a device; and a bus bar connector comprising:

a housing having a slot, the slot being configured to allow the housing to grip the bus bar at different locations;

first and second electrical contact plates disposed on opposite sides of the slot, the first and second electrical contact plates each including a plurality of contact fingers, the contact fingers being arranged on opposing surfaces of the first and second electrical contact plates facing the bus bar;

mounting members for securing the connector housing against an enclosure for the bus bar; and a spring clip configured to attach to upper and lower outer surfaces of the connector housing, the spring clip being adjustable between at least a first original position and a second position in which upper and lower portions of the spring clip bend outwards in opposite directions, the spring clip configured to provide an amount of contact force onto the outer surface of the housing, the amount of contact force causing the contact fingers on the first and second electrical contact plates to securely grip the bus-bar.

14. The system of claim 13, wherein the mounting members include rear contacts attached to the housing.

15. The system of claim 14, wherein the rear contacts are configured to accept mounting lugs for securing the housing to the enclosure.

16. The system of claim 13, wherein the first and second electrical contacts include a ring terminal configured on a tab portion of each contact, the ring terminal being configured to receive an electrical component.

17. The bus bar connector of claim 13, wherein the first and second electrical contacts include a terminal positioned on a tab portion of each contact, the terminal being configured to receive a wiring component to attach one or more wires to the first and second electrical contact plates.

18. The system of claim 13, wherein the housing is configured to allow insertion and removal of the spring clip.

19. The system of claim 13, wherein the upper and lower outer surfaces of the connector housing include grooves for receiving the spring clip.

20. The system of claim 13, wherein the amount of contact force provided by the spring clip onto the outer surface of the housing is approximately 25 lbs.

* * * * *